US008888220B2

(12) United States Patent
Sato

(10) Patent No.: US 8,888,220 B2
(45) Date of Patent: Nov. 18, 2014

(54) PRINTING APPARATUS

(71) Applicant: Seiko Epson Corporation, Shinjuku-ku (JP)

(72) Inventor: Akito Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/091,091

(22) Filed: Nov. 26, 2013

(65) Prior Publication Data

US 2014/0152731 A1 Jun. 5, 2014

(30) Foreign Application Priority Data

Nov. 30, 2012 (JP) ..... 2012-263398

(51) Int. Cl.
*B41J 2/045* (2006.01)
*B41J 2/165* (2006.01)

(52) U.S. Cl.
CPC ..... *B41J 2/04501* (2013.01); *B41J 2/1652* (2013.01)
USPC ..... 347/14; 347/22; 347/35

(58) Field of Classification Search
None
See application file for complete search history.

(56) References Cited

U.S. PATENT DOCUMENTS 8,727,491 B2 * 5/2014 Watanabe ..... 347/35
2011/0242153 A1 10/2011 Kanzaki

FOREIGN PATENT DOCUMENTS

JP 2011-212979 A 10/2011
JP 2011-218724 A 11/2011

* cited by examiner

*Primary Examiner* — Thinh Nguyen
(74) *Attorney, Agent, or Firm* — Kilpatrick Townsend & Stockton LLP

(57) ABSTRACT

A printing apparatus comprising: a first transport unit that transports a printing medium; a line head, having a nozzle row in which the plurality of nozzles are arranged, that ejects the liquid from the nozzles onto the printing medium; a second transport unit, disposed at a distance from the first transport unit downstream from the first transport unit, that further transports the printing medium transported by the first transport unit; and a control unit that causes the line head to execute a flushing operation for ejecting the liquid from the nozzles at a predetermined frequency, wherein when causing the line head to execute the flushing operation, the control unit provides a margin, where the liquid does not land, in a region corresponding to a predetermined distance from a leading end of the printing medium that is an end of the printing medium located toward the second transport unit.

15 Claims, 11 Drawing Sheets

PRINTING APPARATUS

CROSS-REFERENCE TO RELATED APPLICATIONS

This application claims priority to Japanese Patent Application No. 2012-263398 filed on Nov. 30, 2012. The entire disclosure of Japanese Patent Application No. 2012-263398 is hereby incorporated herein by reference.

BACKGROUND

1. Technical Field

The present invention relates to printing apparatuses.

2. Related Art

Ink jet printers that print by ejecting ink from a plurality of nozzles are known. In such an ink jet printer, if no ink is ejected from the nozzles for an extended period of time, the water content of the ink may evaporate through the nozzle openings, causing the ink to thicken. The nozzles may then become clogged by the thickened ink, which in turn may cause operations for ejecting the ink to become unstable. To prevent such an issue from arising, it is preferable to prevent the nozzles from clogging or clear clogs from the nozzles by performing a process known as flushing, in which ink is forcefully ejected from the nozzles.

As related art, JP-A-2011-218724 and JP-A-2011-212979 disclose ink jet printers provided with full multiline recording heads (line heads) in which a plurality of nozzles are arranged in rows across substantially the entire width of a printing medium, where the printers are configured to execute preparatory ejections (that is, flushing) onto the printing medium.

As an example of a printer error that can occur during printing, there are cases where the printing medium jams in a transport path within the printer (called a "paper jam"). Generally speaking, it is easier for jams to occur when the printing medium is slanted, wrinkled, sagging, folded, and so on, but there are also cases where ink droplets ejected onto the printing medium (dots) cause jams. In other words, depending on how dots adhere to the printing medium, there is a risk that the printing medium will not easily separate from a surface in the transport path or an end of the printing medium will easily enter into gaps along the transport path, causing a jam.

SUMMARY

It is an advantage of some aspects of the invention to provide a printing apparatus that makes it possible to avoid the occurrence of jams as described above by manipulating how flushing operations are executed.

A printing apparatus according to one aspect of the invention is a printing apparatus, having a plurality of nozzles for ejecting a liquid, that is capable of executing an operation for ejecting the liquid from the nozzles based on print data for printing an image specified as a printing target, and includes: a first transport unit that transports a printing medium in a transport direction; a line head, having a nozzle row in which the plurality of nozzles are arranged in a direction that intersects with the transport direction, that ejects the liquid from the nozzles onto the printing medium transported by the first transport unit; a second transport unit, disposed at a distance from the first transport unit downstream from the first transport unit in the transport direction, that further transports the printing medium transported by the first transport unit; and a control unit that causes the line head to execute a flushing operation for ejecting the liquid from the nozzles at a predetermined frequency based on data aside from the print data.

Here, when causing the line head to execute the flushing operation, the control unit provides a margin, where the liquid does not land, in a region corresponding to a predetermined distance from a leading end, in the transport direction, of the printing medium that is an end of the printing medium located toward the second transport unit.

According to this configuration, flushing is carried out after providing the margin at the leading end of the printing medium that is located toward the second transport unit. Accordingly, it is possible to avoid a problem in which a jam occurs as a result of the printing medium not easily separating from the first transport unit and entering into a gap between the first transport unit and the second transport unit due to the liquid ejected in the flushing adhering to the leading end, the transport path in the vicinity of the leading end, and so on. Note that the second transport unit further transports the printing medium transported by the first transport unit, and thus the first transport unit and the second transport unit are distanced by an amount that enables the first transport unit and the second transport unit to simultaneously transport the printing media that the printing apparatus can print onto.

According to another aspect of the invention, a size, in the transport direction, of the margin at the leading end may be longer than a gap between the first transport unit and the second transport unit.

According to this configuration, a margin that is longer, in the transport direction, than the gap between the first transport unit and the second transport unit is provided at the leading end of the printing medium. Accordingly, it is possible to avoid a situation in which the leading end of the printing medium that does not easily separate enters into the gap between the first transport unit and the second transport unit and causes a jam.

According to another aspect of the invention, the printing apparatus may further include a separating plate, located between the first transport unit and the second transport unit, for separating the printing medium from the first transport unit; here, a size, in the transport direction, of the margin at the leading end may be longer than a gap between the first transport unit and the separating plate.

According to this configuration, a margin that is longer, in the transport direction, than the gap between the first transport unit and the separating plate is provided at the leading end of the printing medium. Accordingly, it is possible to avoid a situation in which the leading end of the printing medium that does not easily separate enters into the gap between the first transport unit and the separating plate and causes a jam.

According to another aspect of the invention, the size of the margin at the leading end may be longer, in the transport direction, than a size by which a minimum distance between the leading end and the first transport unit is longer than a minimum distance between the first transport unit and an intake port, at the point in time when the leading end is transported to a straight line passing through an area where the distance between the first transport unit and the intake port of the second transport unit is shortest.

According to this configuration, a margin of a size sufficient enough to make it easy for the leading end of the printing medium to enter into the intake port of the second transport unit can be provided at the leading end. Accordingly, it is possible to avoid a situation in which the leading end of the printing medium enters into the gap between the first transport unit and the second transport unit and causes a jam.

According to another aspect of the invention, the size of the margin at the leading end may be longer, in the transport direction, than a minimum distance between the leading end and the part of the printing medium where the printing medium begins to separate from the first transport unit at the point in time when the leading end is transported into the intake port of the second transport unit.

According to this configuration, a margin of a size sufficient enough to make it easy for the leading end of the printing medium to enter into the intake port of the second transport unit can be provided at the leading end. Accordingly, it is possible to avoid a situation in which the leading end of the printing medium enters into the gap between the first transport unit and the second transport unit and causes a jam.

According to another aspect of the invention, when causing the line head to execute the flushing operation, the control unit may provide a margin, where the liquid does not land, at both ends of the printing medium in the direction that intersects with the transport direction.

According to this configuration, it is possible to prevent the transport path from being soiled by the flushing in the vicinity of both ends of the printing medium in the direction that intersects with the transport direction even in the case where the transported printing medium is slanted or meandering relative to the transport direction.

According to another aspect of the invention, the printing apparatus may further include a third transport unit that inverts the front and back of the printing medium transported by the first transport unit and sends the inverted printing medium to the first transport unit from upstream in the transport direction; here, when causing the line head to eject the liquid onto both sides of the printing medium and execute the flushing operation, the control unit may provide a margin, where the liquid does not land, at both ends of the printing medium in the transport direction.

In the case of double-sided printing, the end of the printing medium that faces downstream during printing on one side faces upstream during printing on the reverse side, after being transported by the third transport unit. Likewise, the end of the printing medium that faces upstream during printing on one side faces downstream during printing on the reverse side. Accordingly, jams can be avoided when printing on both the front and the rear sides by providing the margin at both ends of the printing medium in the transport direction and carrying out the flushing.

According to another aspect of the invention, a plurality of the line heads may be disposed along the transport direction; and when causing the line heads to eject the liquid based on print data to which has been added blank data for correcting positional skew caused by error in intervals between the plurality of line heads in the transport direction, the control unit may cause the flushing operation to be executed while avoiding a location of the blank data.

Depending on the magnitude of error in the intervals at which the line heads are disposed, the range to which the blank data is applied may actually span across the end of the printing medium that is transported. Accordingly, by carrying out flushing so as to avoid the location of the blank data as described above, it is possible to avoid soiling the ends of the printing medium, the transport path in the vicinity of those ends, and so on (that is, avoid creating a cause of jams).

According to another aspect of the invention, the printing apparatus may further include a detection unit that detects a printing medium jam upstream from the line head in the transport direction; here, the control unit may prohibit the flushing operation from being executed in the case where the printing medium jam has been detected by the detection unit.

According to this configuration, the flushing is prohibited in the case where a printing medium jam has occurred upstream from the line head, and thus it is possible to avoid soiling the transport path by the flushing.

According to another aspect of the invention, the control unit may be capable of specifying a different value for a distance, in the transport direction, between a region where the liquid is ejected based on the print data and the leading end, from the size, in the transport direction, of the margin at the leading end.

According to this configuration, a user can specify the region in which the liquid is ejected based on the print data as a desired location, and thus the ease of operating the printing apparatus can be increased.

According to another aspect of the invention, in the case where a distance, in the transport direction, between a region where the liquid is ejected based on the print data and the leading end that is smaller than a value for the size, in the transport direction, of the margin at the leading end is specified, the control unit may cause an error to be communicated.

According to this configuration, the likelihood that the liquid will be ejected on the ends of the printing medium and in the vicinity thereof can be reduced as a result of the error being communicated.

According to another aspect of the invention, in the case where a distance, in the transport direction, between a region where the liquid is ejected based on the print data and the leading end that is greater than a value for the size, in the transport direction, of the margin at the leading end is specified, the control unit may cause the line head to eject the liquid based on the specified value.

According to this configuration, a user can specify the region in which the liquid is ejected based on the print data as a desired location, and thus the ease of operating the printing apparatus can be increased.

According to another aspect of the invention, of a region of the printing medium where the liquid can be ejected, the print data may be data of a size corresponding to a region of the printing medium onto which the liquid is ejected based on the print data; and the control unit may cause the line head to execute the flushing operation on a region of the printing medium that is greater than the region corresponding to the print data.

According to this configuration, the load of computation processing performed on the data can be reduced by setting the print data to a minimum necessary size, and thus the necessary flushing can then be carried out. The computation processing can include resolution conversion processing, color system conversion processing (color conversion processing), halftone processing, and the like. Meanwhile, the region on which flushing operations are carried out may be set to a region that is greater than the region corresponding to the print data. Accordingly, the necessary flushing operations can be carried out across a wide region.

According to another aspect of the invention, the control unit may be capable of switching the operation for ejecting the liquid from the nozzles based on the print data between execution in a monochromatic mode and execution in a color mode; and the margin at the leading end of the printing medium may be provided regardless of whether the ejection is executed in the monochromatic mode or in the color mode.

According to this configuration, it is possible to avoid the occurrence of jams caused by the leading end of the printing medium entering between the transport paths, regardless of which mode is used.

According to another aspect of the invention, the control unit may be capable of executing the operation for ejecting the liquid from the nozzles based on the print data on a plurality of pieces of the printing medium; and when causing the line head to execute the flushing operation, the control unit may provide a margin, where the liquid does not land, at the leading end of each of the plurality of pieces of the printing medium.

According to this configuration, it is possible to avoid the occurrence of jams caused by the leading end of the printing medium entering between the transport paths, even in the case where a plurality of printing media are used.

In addition to being realized as a printing apparatus, the technical spirit of the invention may be realized as other entities (apparatuses) as well. Likewise, a method (printing method) invention including steps corresponding to the features of the printing apparatus according to any of the aforementioned aspects, a printing control program invention that causes predetermined hardware (a computer) to execute that method, an invention in which the program is recorded on a computer-readable recording medium, and so on are also included in this technical spirit. Furthermore, the printing may be implemented by a single apparatus (a printer provided with a liquid ejecting function), or may be implemented by a combination of a plurality of apparatuses.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described hereinafter with reference to the drawings.

1. Apparatus Overview

Figure 1:
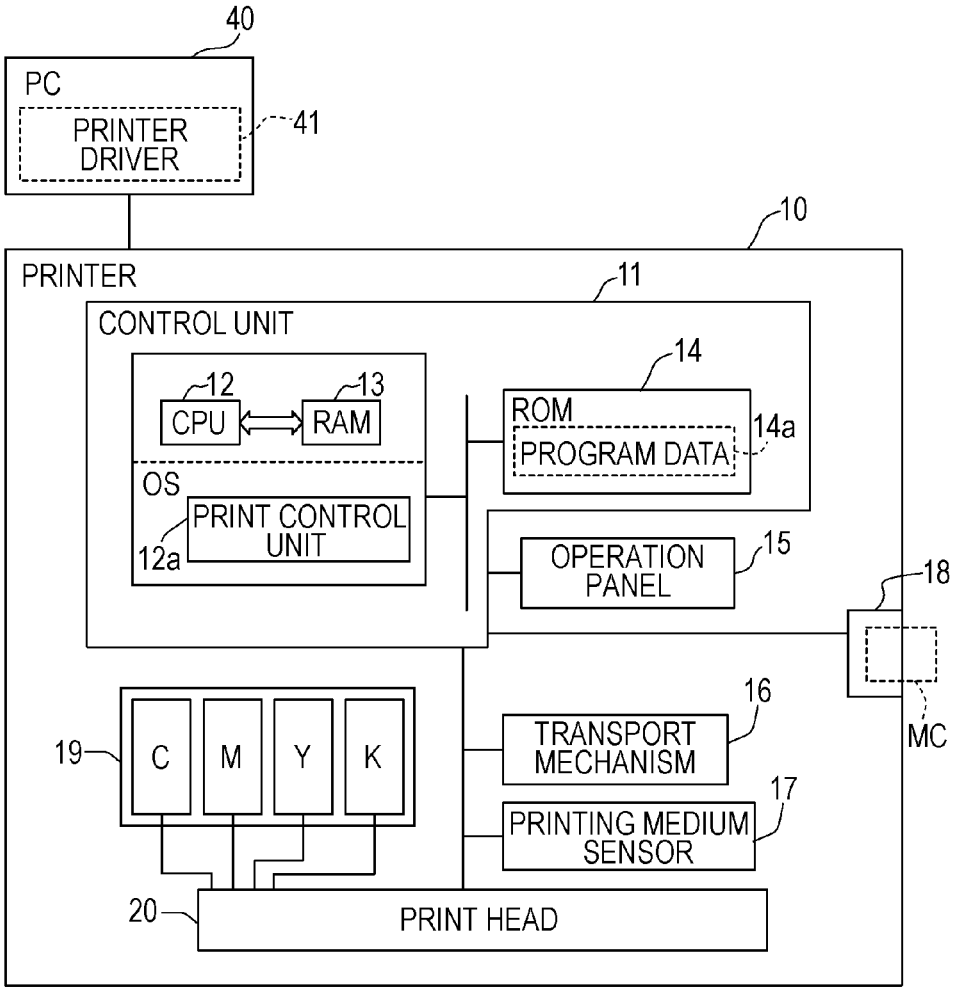
FIG. 1 is a diagram schematically illustrating a hardware configuration and a software configuration.

FIG. 1 is a diagram schematically illustrating a hardware configuration and a software configuration according to this embodiment. FIG. 1 illustrates a personal computer (PC) 40 and a printer 10. The printer 10 corresponds to a printing apparatus. Alternatively, a system including the PC 40 and the printer 10 may be taken as a printing apparatus. The printer 10 includes a control unit 11 for controlling a liquid ejection process (a printing process). In the control unit 11, a CPU 12 runs firmware for controlling the printer 10 by loading program data 14*a* stored in a memory such as a ROM 14 into a RAM 13 and carrying out processes in accordance with that program data 14*a* under an OS. The firmware is a program through which the CPU 12 executes functions of a print control unit 12*a* and the like.

The print control unit 12*a* receives image data from, for example, the PC 40, a storage medium inserted into the printer 10 from the exterior, or the like, and generates print data from the image data. Printing can then be carried out based on that print data. The storage medium inserted into the printer 10 from the exterior is, for example, a memory card MC, and the memory card MC is inserted into a slot portion 18 formed in a housing of the printer 10. The print control unit 12*a* can also receive image data from a variety of other external devices, including scanners, digital still cameras, mobile terminals, and the like connected to the printer 10 through wires or wirelessly, as well as a server or the like connected to the printer 10 over a network. The image data represents an image specified to be printed by a user as desired (that is, a printing target image). The image data is bitmap data, for example, and is RGB data having red, green, and blue (R, G, and B) color system tones for each pixel, ink amount data having tones in an ink color system used by the printer 10 (cyan (C), magenta (M), yellow (Y), black (K), and so on) for each pixel, or the like. The print control unit 12*a* generates the print data by carrying out a resolution conversion process, a color system conversion process (color conversion process), a halftone process, and the like on the bitmap data. The print data is data specifying, for example, whether liquid (ink) will be ejected (dot on) or will not be ejected (dot off) for each pixel and for each type of ink.

Alternatively, the print control unit 12*a* can receive print data generated from the stated image data by a printer driver 41 installed in the PC 40, from the PC 40, and can then carry out printing based on the received print data. The print control unit 12*a* can also receive predetermined page description language (PDL) data from the printer driver 41 and print the printing target image based on the PDL data. In this case, the print control unit 12*a* analyzes the PDL data and converts the PDL data into intermediate code, and then generates the aforementioned bitmap data in the RAM 13 by expanding that intermediate code. The print control unit 12*a* then generates the aforementioned print data from the bitmap data.

The printer 10 includes ink cartridges 19, one for each of a plurality of types of ink. In the example shown in FIG. 1, the ink cartridges 19 are provided for each of CMYK inks. However, the specific types, number, and so on of ink used by the printer 10 are not limited to those described above, and a variety of inks can be used, including light cyan, light magenta, orange, green, gray, light gray, white, metallic inks, and the like. The printer 10 also includes a print head 20 that ejects (discharges) ink supplied from the ink cartridges 19 through multiple ink ejection nozzles. The print head 20 is what is known as a line head, having an elongated shape.

Based on the stated print data, the print control unit 12*a* generates driving signals for driving the print head 20, a transport mechanism 16, and the like. In the print head 20, piezoelectric elements for causing ink droplets (dots) to be ejected from nozzles 21 are provided for each of the nozzles 21. The piezoelectric elements deform when the stated driving signals are applied thereto, and as a result, ink is ejected from the corresponding nozzles 21. The transport mechanism 16 includes a motor (not shown), rollers 16*a* and 16*b* (see FIG. 2) that are driven by the motor, and so on, and transports the printing medium along a predetermined transport direction by experiencing driving control performed by the print control unit 12*a*. When ink is ejected from the nozzles 21 in the print head 20, the dots land on the printing medium that is being transported, and the printing target image based on the stated print data is reproduced upon the printing medium as a result.

The printer 10 further includes an operation panel 15. The operation panel 15 includes a display unit (a liquid-crystal panel, for example), a touch panel formed in the display unit, various types of buttons or keys, and the like; the operation panel 15 accepts inputs from a user, displays necessary user interface (UI) screens in the display unit, and so on. The printer 10 may also include a printing medium sensor 17.

Figure 2:
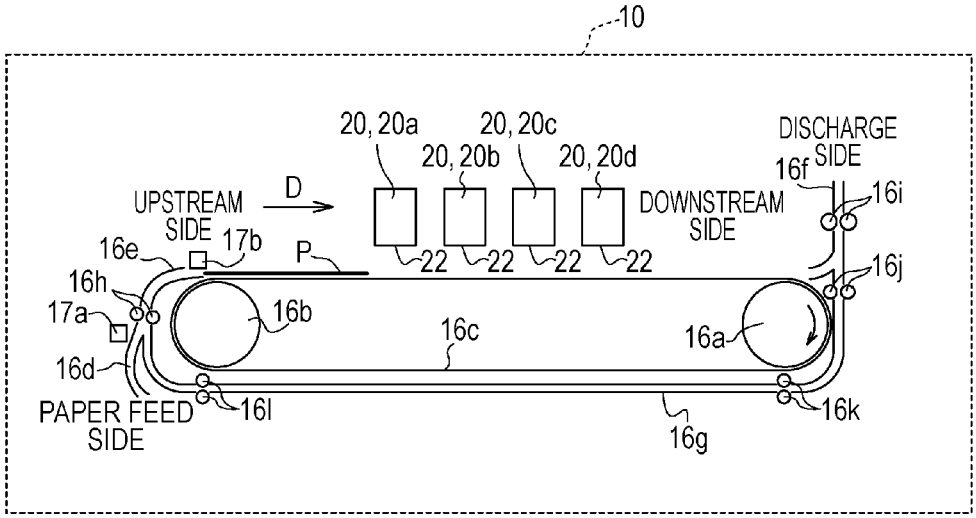
FIG. 2 is a diagram illustrating an example of part of the internal configuration of a printer, in a simplified manner.

FIG. 2 illustrates an example of part of the internal configuration of the printer 10 in a simplified manner, as seen along the lengthwise direction of the print head 20.

Figure 3:
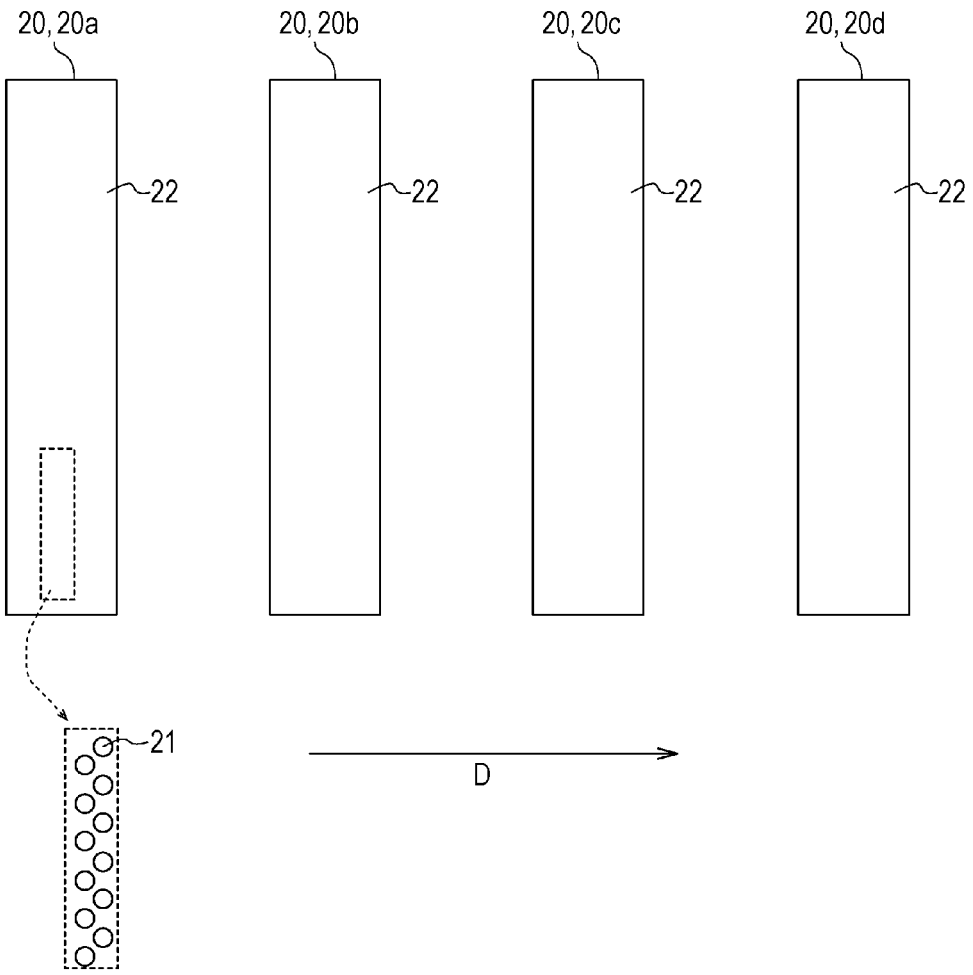
FIG. 3 is a diagram illustrating an example of a nozzle opening surface side of a print head, in a simplified manner.

FIG. 3, meanwhile, illustrates an example of the print head 20 in a simplified manner, seen from a nozzle opening surface 22 side (that is, a surface in which are formed openings for the nozzles 21).

The print head 20 includes a plurality of line heads 20*a*, 20*b*, 20*c*, and 20*d* that are provided on an ink type-by-ink type basis. For example, the line head 20*a* is capable of ejecting C ink, the line head 20*b* is capable of ejecting M ink, the line head 20*c* is capable of ejecting Y ink, and the line head 20*d* is capable of ejecting K ink. The line heads 20*a*, 20*b*, 20*c*, and 20*d* are affixed at predetermined positions within the printer 10 so as to be parallel to each other in the lengthwise direction. Hereinafter, "lengthwise direction" will, unless otherwise specified, always refer to the lengthwise directions of the print head 20 (that is, the line heads 20*a*, 20*b*, 20*c*, and 20*d*).

The line heads 20*a*, 20*b*, 20*c*, and 20*d* take a direction that intersects with a transport direction D of the printing medium P (see FIG. 2) as the lengthwise direction, and are disposed at set intervals in the transport direction D. Here, "intersects with" is assumed to mean "orthogonal to". However, "orthogonal to" as referred to in this specification does not strictly refer only to 90° angles, and includes an amount of angular error permissible from the standpoint of product quality. The line heads 20*a*, 20*b*, 20*c*, and 20*d* each include nozzle rows in which a plurality of the nozzles 21 are arranged in the lengthwise direction. Each nozzle row has a length that corresponds to, of the total width of the printing medium in the lengthwise direction, at least the width of a printable region on the printing medium. FIG. 3 illustrates an example in which a range of the nozzle rows in the nozzle opening surface 22, indicated by the dotted lines, is illustrated in an enlarged manner. A nozzle density of the nozzle rows in the lengthwise direction (that is, the number of nozzles per inch) is equal to the printing resolution (dpi) in the lengthwise direction. A nozzle row corresponding to a single type of ink may be configured only of a single nozzle row arranged along the lengthwise direction, or, as shown in FIG. 3, may be configured of a plurality of nozzle rows that are parallel to each other and are shifted in the lengthwise direction by a predetermined pitch.

As shown in FIG. 2, and endless belt 16*c* that moves while being engaged with the rotating rollers 16*a* and 16*b* is provided in the printer 10 as part of the transport mechanism 16, in a position that faces the nozzle opening surface 22 of the print head 20. In addition, as part of the transport mechanism 16, transport paths 16*d* and 16*e* are formed spanning from a side on which the printing medium P is fed (that is, a paper feed tray side) to an upstream side of the endless belt 16*c* (that is, an upstream side in the transport direction D), and furthermore, a transport path 16*f* is formed spanning from a downstream side of the endless belt 16*c* (that is, a downstream side in the transport direction D) to a side on which the printing medium P is discharged (that is, a discharge tray side). As a further part of the transport mechanism 16, a transport path 16*g* is formed so as to branch partway along the transport path 16*f*; the transport path 16*g* then merges with the transport path 16*d* and connects to the transport path 16*e*. Further still, rollers 16*h*, 16*i*, 16*j*, 16*k*, and 161 that are rotated by a motor (not shown) and transport the printing medium P are disposed in predetermined locations in the transport paths 16*d*, 16*e*, 16*f*, and 16*g* as part of the transport mechanism 16.

When the printer 10 executes one-sided printing on the printing medium P, the printing medium P is transported by the transport mechanism 16 from the paper feed side, through the transport paths 16*d* and 16*e*, and to the upstream side of the endless belt 16*c*. The printing medium P that has reached the endless belt 16*c* is transported by the endless belt 16*c* from the upstream side toward the downstream side in the transport direction D, and as the printing medium P passes under the nozzle opening surface 22 of the print head 20, the surface of the printing medium P that faces the nozzle opening surface 22 receives ink ejected therefrom. When a downstream-side end of the printing medium P (also called a "leading end") has reached the transport path 16*f*, the printing medium P is then discharged toward the discharge side through the transport path 16*f*. The endless belt 16*c* is an example of a first transport unit in the aspects of the invention. The transport path 16*f*, meanwhile, is an example of a second transport unit in the aspects of the invention.

The printer 10 is also capable of executing double-sided printing on the printing medium P. In this case, at a predetermined timing at which the printing medium P that has been printed onto one side is conducted to the transport path 16*f*, the transport mechanism 16 causes the roller 16*i* to rotate in the reverse direction as the direction for transporting the printing medium P to the discharge side. This leads the printing medium P to the transport path 16*g*. The printing medium P passes through the transport paths 16*g* and 16*e*, and once again reaches the upstream side of the endless belt 16*c*. At this time, the opposite surface of the printing medium P as the surface that has been printed onto as described above faces the nozzle opening surface 22 (that is, the front and back of the printing medium P are inverted). Accordingly, at least some of the transport paths 16*f*, 16*g*, and 16*e* correspond to an example of a third transport unit that inverts the front and back of the printing medium P transported by the first transport unit and then feeds the inverted printing medium P from the upstream side in the transport direction D toward the first transport unit. The printing medium P that has once again reached the endless belt 16*c* is transported from the upstream side toward the downstream side in the transport direction D, and during this time, receives ink ejected from the print head 20 onto the aforementioned reverse-side surface. The printing medium P whose reverse-side surface has been printed onto and that has reached the transport path 16*f* (that is, the printing medium P that has experienced double-sided printing) is then discharged to the discharge side through the transport path 16*f*.

In this embodiment, the printer 10 is capable of executing a flushing process. "Flushing" is a process for ejecting ink from the nozzles 21 based on data that is not the aforementioned print data. Dots ejected based on the aforementioned print data are called "image forming dots", whereas dots ejected based on data that is not the aforementioned print data are called "flushing dots".

2. Flushing Control Process

Figure 4:
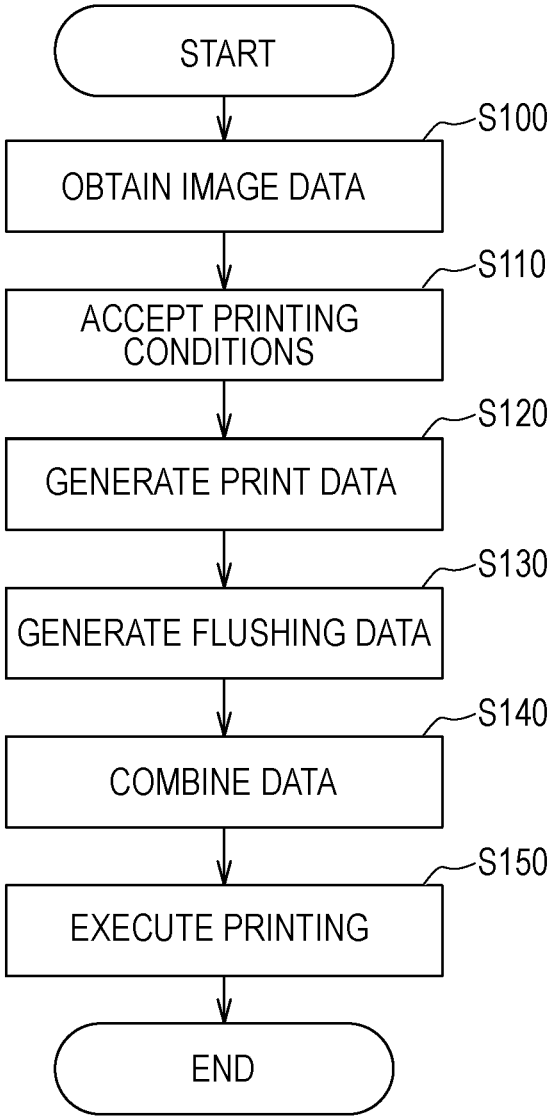
FIG. 4 is a flowchart illustrating a flushing control process.

FIG. 4 is a flowchart illustrating a flushing control process carried out assuming the aforementioned configuration. The flushing control process is a process that executes flushing on a printing medium having provided a margin, where ink does not land, corresponding to at least a predetermined region spanning from the leading end of the printing medium; the flushing control process is generally executed along with a printing process for printing a printing target image. Note that the printing process for printing a printing target image has already been described to an extent, and thus descriptions thereof will be simplified as appropriate. Furthermore, preventing ink from landing in a region corresponding to a predetermined distance from an end of the printing medium will be referred to hereinafter as "providing a margin" at an end of the printing medium. Further still, the expression "a margin at an end" refers to a region, corresponding to a predetermined distance from the end, in which ink does not land.

In step S100, the print control unit 12*a* accepts a specification of a printing target image from the user via the operation panel 15. The user specifies the printing target image to the printer 10 by manipulating the operation panel 15 and selecting a desired printing target image through the UI screen displayed in the display unit. As a result, the print control unit 12*a* obtains image data expressing the printing target image from the PC 40, a storage medium, a given information source such as an external device, or the like, as described above. Of course, the user can also specify the printing target image by operating a mobile terminal or the like capable of remotely controlling the printer 10 from the exterior.

In step S110, the print control unit 12*a* accepts printing conditions, employed when printing the printing target image, in response to a user input made via the operation panel 15 (or via a mobile terminal or the like capable of remote control, as mentioned above). A variety of conditions are accepted as the printing conditions, such as a type and size of the printing medium, a printing orientation, a layout on the printing medium, a printing resolution, one-sided printing or double-sided printing, settings for the position of the printing target image on the printing medium, and so on.

In step S120, the print control unit 12*a* generates print data from the image data as described above. The user can also cause the printer 10 to print the printing target image by operating the PC 40. In other words, this corresponds to the aforementioned case where the printer 10 receives print data, PDL data, or the like from the printer driver 41. In such a case, the user selects the printing target image, inputs the printing conditions, and so on via a UI screen presented by the printer driver 41 in a display of the PC 40. Meanwhile, information indicating the inputted printing conditions is sent from the PC 40 to the printer 10 along with the print data, PDL data, or the like of the selected printing target image. Accordingly, in the case where the printing condition information is sent from the PC 40 along with the print data, the PDL data, and the like, the aforementioned steps S100 and S110 are assumed to be executed with the print control unit 12*a* obtaining that information as well. Note that the process of step S120 is already complete in the case where the print data is sent from the PC 40. However, in the case where PDL data is sent from the PC 40, the print data is generated from the PDL data in step S120.

In step S130, the print control unit 12*a* generates flushing data for forming flushing dots. The flushing data is an example of the aforementioned data that is not print data. In this case, based first on the size of the printing medium and a margin value, the print control unit 12*a* specifies a size of a printable region in the printing medium (length in the transport direction D in the lengthwise direction). The size of the printing medium is defined by the printing condition information inputted in step S110. The margin value, meanwhile, is a margin amount to be secured at the end of the printing medium, and the value thereof is determined in advance based on structural features of the transport path and so on in the printer 10, as will be described later.

Figure 5:
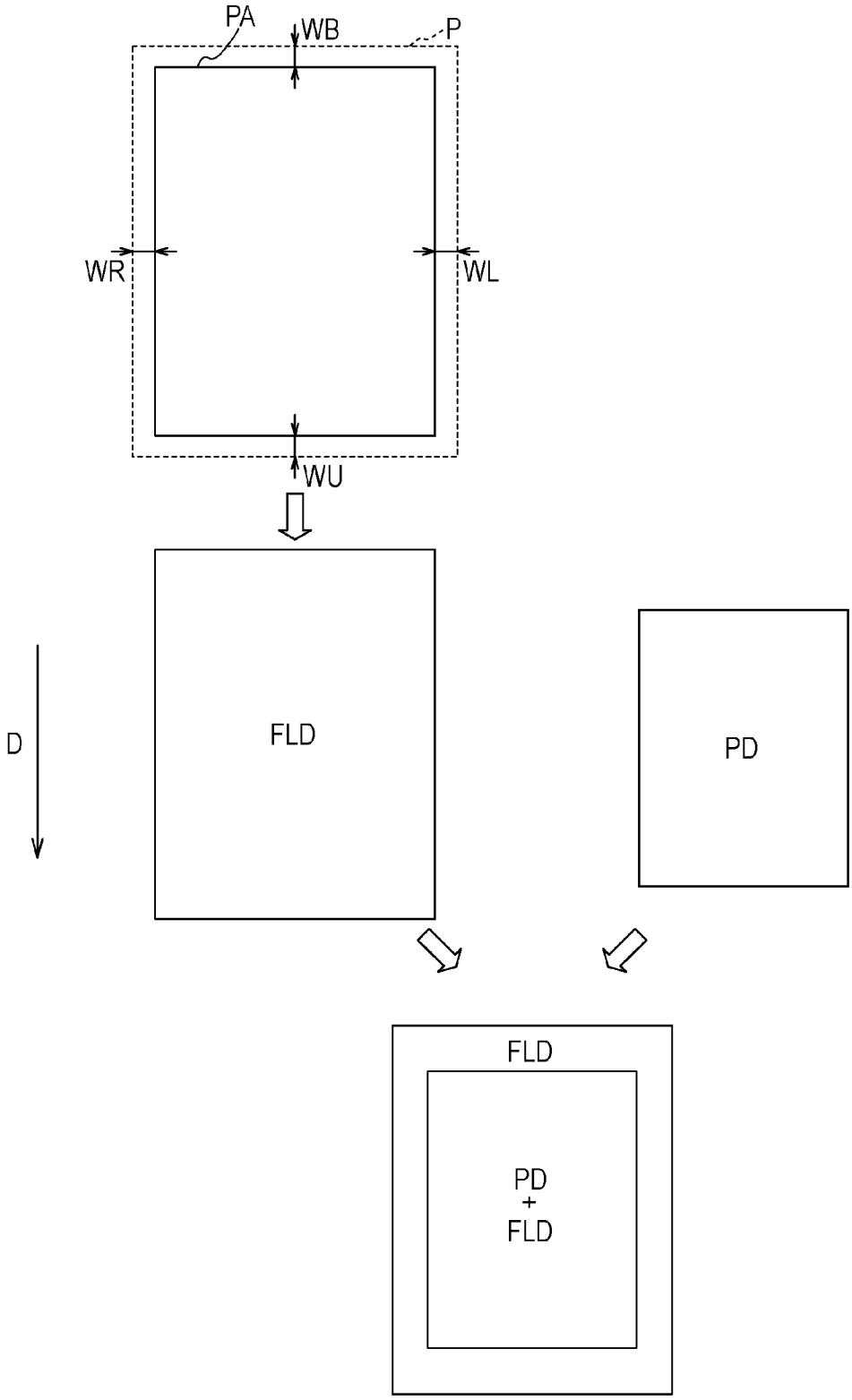
FIG. 5 is a diagram illustrating steps S130 and S140 in a simplified manner.

FIG. 5 is a diagram illustrating the processes of steps S130 and S140 in a simplified manner. An upper area of FIG. 5 illustrates an example of the size of the printing medium P, indicated by the dotted-line rectangle. The position and size of a printable region PA defined based on margin values WU, WB, WL, and WR are indicated by a solid line rectangle within the aforementioned size of the printing medium P. The margin value WU indicates a margin amount at the leading end of the printing medium P, whereas the margin value WB indicates a margin amount at the end of the printing medium P that is on the upstream side in the transport direction D (this will also be referred to as a "following end"). The margin values WL and WR respectively indicate margin amounts on both sides of the printing medium P in the direction orthogonal to the transport direction D (that is, the lengthwise direction), and WL=WR, for example. It is assumed that of the margin values WU, WB, WL, and WR, at least the margin value WU is a value greater than 0. To rephrase, the margin values WB, WL, and WR may be 0. However, the descriptions will be continued hereinafter assuming that all of the margin values WU, WB, WL, and WR have values that are greater than 0.

Once the size of the printable region PA has been specified as described above, the print control unit 12*a* specifies a flushing data size (that is, a number of pixels in both the transport direction D and the lengthwise direction), based on the size of the printable region PA and the printing resolutions in the transport direction D and the lengthwise direction. The printing resolution in the transport direction D is set based on the printing condition information inputted in step S110. The printing resolution in the lengthwise direction is already set; that is, corresponds to the nozzle density in the lengthwise direction of the nozzle rows, as described above. Once the flushing data size has been specified, the print control unit 12*a* generates data virtually expressing a dot pattern that, for example, repeats dots at set intervals in the transport direction D, for all pixel rows (rows of pixels parallel to the transport direction D) that configure an image region corresponding to the flushing data size. This generated data is the flushing data. Ink is ejected from the nozzles at a predetermined rate by ejecting the ink based on the flushing data. The middle-left side of FIG. 5 illustrates an example of flushing data FLD. The print control unit 12*a* generates the flushing data FLD for each type of ink.

In step S140, the print control unit 12*a* combines (superimposes) the flushing data and the print data. The print data is data of a size (number of pixels) corresponding only to the rectangular region, in the printable region PA, in which dots are ejected in order to print the printing target image, and thus does not exceed the size (number of pixels) of the flushing data. In other words, the size of the print data is also adjusted in accordance with the size of the printing medium and the margin values WU, WB, WL, and WR. Furthermore, the size of the print data does not always correspond to the entire size of the printable region PA, and is varied in accordance with the rectangular region corresponding to the printing target image. The respective positions of the flushing data and the print data on the printing medium are specified, and the print control unit 12*a* then combines both pieces of data in accordance with the respective positions of the flushing data and the print data on the printing medium. Here, the flushing data and print data corresponding to the same ink types are combined, and thus combined data is obtained for each ink type. The combined data is data that forms dots on the printing medium that correspond to each pixel for which "dot on" is obtained by a logical sum in the result of the combination. The middle-right side in FIG. 5 illustrates an example of print data PD, and the lower section of FIG. 5 indicates an example of a result of combining the flushing data FLD and the print data PD. As shown in FIG. 5, in the combined data, the stated logical sum is employed in the range where the flushing data FLD and the print data PD overlap, whereas only the flushing data FLD is employed in the range where only the flushing data FLD is present.

In step S150, the print control unit 12*a* carries out a rasterizing process for rearranging the stated combined data into an order in which the data is to be transferred to the print head 20 (the line heads 20*a*, 20*b*, 20*c*, and 20*d*). Through the rasterizing process, the timing at which each dot specified in the stated combined data and which of the nozzles 21 in the line heads 20*a*, 20*b*, 20*c*, and 20*d* will form those dots are finalized in accordance with the pixel positions and colors (ink types) of those dots. Ink is ejected from the print head 20 (the line heads 20*a*, 20*b*, 20*c*, and 20*d*) in accordance with a result of this process.

Figure 6:
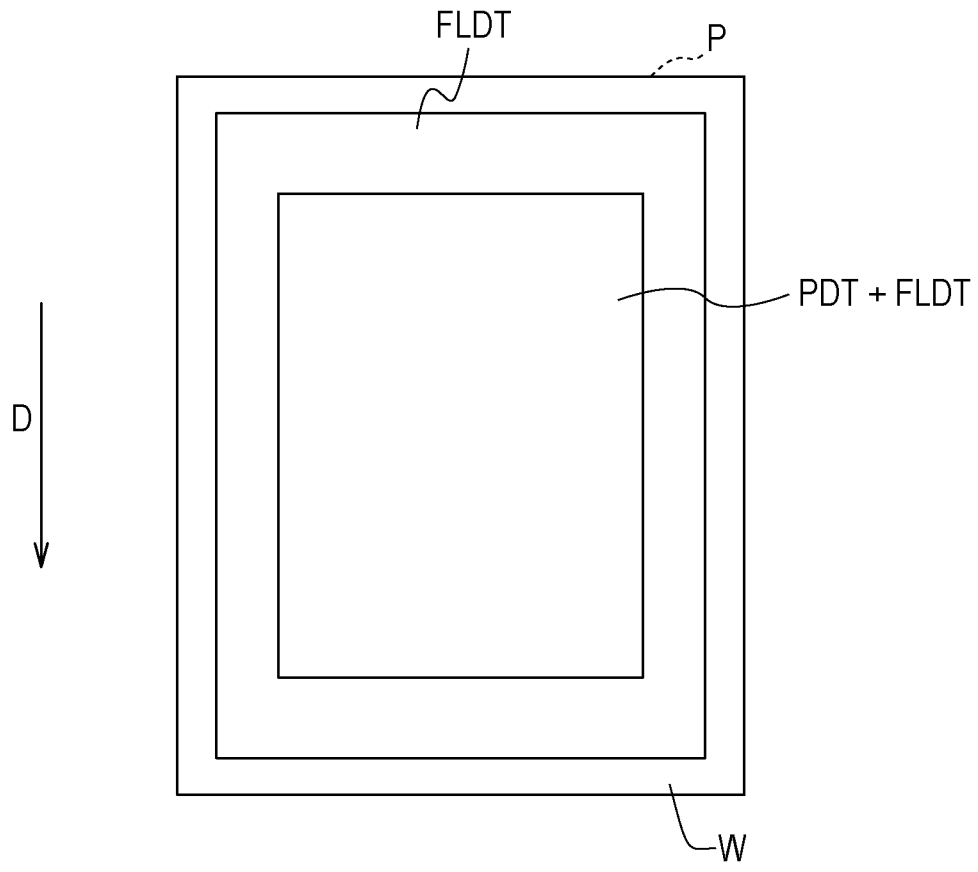
FIG. 6 is a diagram illustrating an example of a printing result reproduced on a printing medium.

FIG. 6 illustrates an example of a printing result reproduced on the printing medium P based on the result of FIG. 4. In this printing result, a margin W based on the margin value WU is secured in at least the leading end of the ends of the printing medium P. Note that in this embodiment, a margin W based on each of the margin values WU, WB, WL, and WR (that is, a frame-shaped margin) is secured at all four ends of the printing medium P, including the leading end. In the region corresponding to the print data, the printing target image is reproduced by image forming dots PDT that are based on the print data, and flushing dots FLDT based on the flushing data are also formed. Meanwhile, the flushing dots FLDT based on the flushing data are formed in the printable region PA, in a region aside from the print data.

A method for determining the margin value WU will be described hereinafter.

Figure 7A:
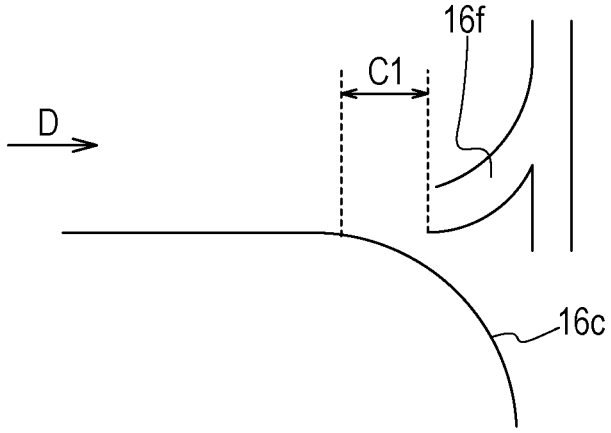
FIGS. 7A and 7B are diagrams illustrating an example of an area where a downstream side of an endless belt and a transport path are in proximity with each other, in an enlarged manner.
Figure 7B:
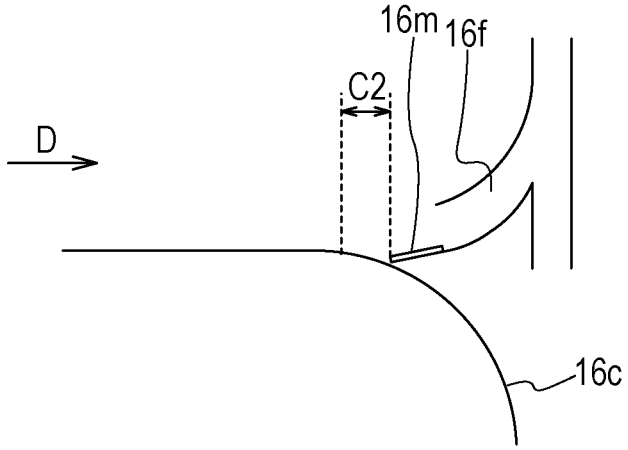

FIGS. 7A and 7B illustrate examples of an area, corresponding to part of the internal configuration of the printer 10, where the downstream side of the endless belt 16*c* and the transport path 16*f* are in proximity with each other, in an enlarged manner. As shown in FIG. 7A, a gap C1 is present between the endless belt 16*c* and the transport path 16*f* in the transport direction D. When ink adheres to the leading end and the vicinity thereof on the printing medium, the printing medium may bend under the weight of the ink and the leading end may sag as a result. In such a state, it is easy for the leading end to enter into the gap C1, and a jam can occur if the leading end enters into the gap C1 in such a manner. Accordingly, the margin value WU is set to specify a distance that is at least longer than the gap C1. Through this, a margin that is longer than the gap C1 in the transport direction D can be secured at the leading end of the printing medium, and the occurrence of jams can be avoided as a result.

Alternatively, as shown in FIG. 7B, a separating plate 16*m* for separating the printing medium from the endless belt 16*c* and passing the printing medium to the transport path 16*f* may be provided between the endless belt 16*c* and the transport path 16*f*. With this configuration, a gap C2 is present between the endless belt 16*c* and the separating plate 16*m* in the transport direction D. Accordingly, the margin value WU may specify a distance that is longer at least than the gap C2 in order to avoid a situation where the leading end of the printing medium enters into the gap C2. Through this, a margin that is longer than the gap C2 in the transport direction D can be secured at the leading end of the printing medium, and the occurrence of jams can be avoided as a result. Note that a simplest configuration can be obtained by setting the other margin values WB, WL, and WR to the same value as the margin value WU.

The specific method for realizing the flushing control process is not limited to the aforementioned method.

Figure 8:
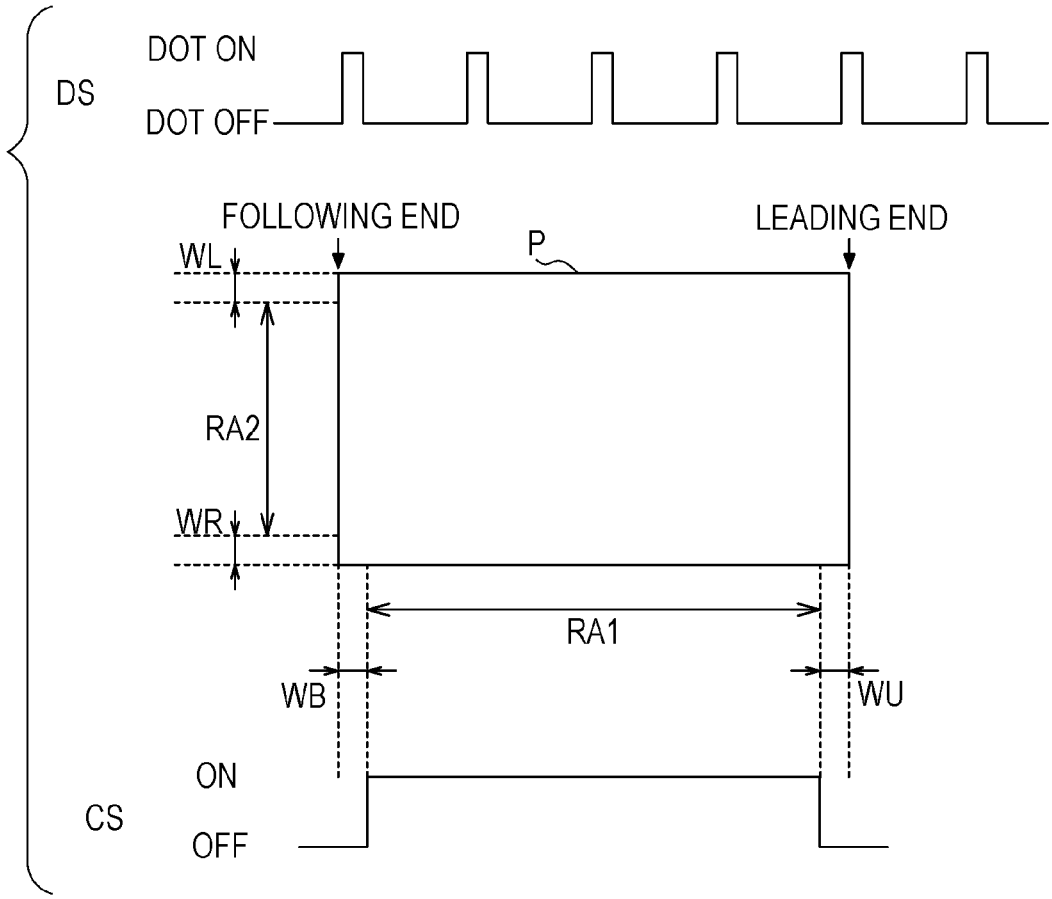
FIG. 8 is a diagram illustrating another method for realizing a flushing control process.

FIG. 8 is a diagram illustrating another method for realizing the flushing control process. In the case where the method illustrated in FIG. 8 is employed, the printer 10 ejects ink based on the print data (that is, prints the printing target image) in parallel with the flushing control process. Here, steps S130 and S140 (see FIG. 4) are unnecessary and thus not executed. FIG. 8 illustrates examples of a driving signal DS and a control signal CS supplied to the print head 20 by the control unit 11. The driving signal DS and the control signal CS shown in FIG. 8 correspond to an example of the data that is not the print data. The driving signal DS has a waveform that, for example, enters an "on" state every set period of time, and is supplied to all of the nozzles 21 in the print head 20 (and specifically, to the piezoelectric elements provided corresponding to the nozzles 21; the same applies hereinafter). The "on" state of the driving signal DS defines a timing at which the flushing dots are ejected from the nozzles 21.

On the other hand, the control signal CS is supplied to some of the nozzles 21. Specifically, of the nozzles 21 arranged in the lengthwise direction of the line heads 20*a*, 20*b*, 20*c*, and 20*d*, the control signal CS is supplied to the nozzles 21 present within a range corresponding to the printable region of the printing medium P in the lengthwise direction thereof (see a range RA2 in FIG. 8). The control signal CS has a waveform that enters the "on" state only in a range corresponding to the printable region of the printing medium P in the transport direction D (see a range RA1 in FIG. 8). In other words, the control signal CS enters the "on" state only during a period, in which the landing operations of the dots produced by the line heads 20*a*, 20*b*, 20*c*, and 20*d* in the transport path are carried out, spanning from the timing at which the leading end of the printing medium P has been passed and transported by an amount equivalent to the margin value WU to when the printing medium P is transported by an amount equivalent to the range RA1. According to this configuration, the print head 20 causes the flushing dots to be ejected from the nozzles 21 in response to the driving signal DS going "on" only in the case where the control signal CS is "on" as well. Accordingly, the flushing is carried out on the printing medium P while ensuring the margin W corresponding to the margin values WU, WB, WL, and WR (that is, a frame-shaped margin) is present on the printing medium P.

A sensor capable of detecting the printing medium P (for example, a sensor 17*b* shown in FIG. 2; a type of the printing medium sensor 17) is provided in the transport path within the printer 10, upstream from the print head 20. Accordingly, the control unit 11 can set the timing at which to supply the control signal CS to the nozzles 21 based on a timing at which the sensor 17*b* detects the leading end of the printing medium P, a velocity of the endless belt 16*c*, a distance from the sensor 17*b* to the landing positions of the dots produced by the respective line heads 20*a*, 20*b*, 20*c*, and 20*d*, and the margin value WU. Flushing that ensures the presence of the margin W as described above can be realized by supplying the control signal CS to the nozzles 21 at the set timings.

According to this embodiment, the printer 10 executes flushing on the printing medium having provided a margin where ink is not caused to land, at least on the leading end of the printing medium. Accordingly, one cause of jams, namely that it becomes difficult for the printing medium to separate from the transport path due to dots landing (or extending) across the leading end of the printing medium and the transport path (the endless belt 16*c*), is eliminated. A problem in which jams become likelier to occur due to the leading end of the printing medium sagging under the weight of the ink is also eliminated.

Meanwhile, in this embodiment, the printer 10 carries out flushing onto the printing medium having provided the margin W on both ends of the printing medium in the direction that intersects with (is orthogonal to) the transport direction D, as can be seen from the illustrations in FIGS. 5 and 6 and the supporting descriptions. Accordingly, it is possible to prevent the transport path (the endless belt 16*c*) from being soiled by the flushing in the vicinity of the stated both ends even in the case where the transported printing medium is slanted or meandering relative to the transport direction D. Accordingly, one cause of jams, namely that it becomes difficult for the printing medium to separate from the transport path due to dots landing (or extending) across the stated both sides and the transport path (the endless belt 16*c*), is eliminated.

Furthermore, in this embodiment, the stated print data is data of a size corresponding to the region, in the printable region of the printing medium, in which ink is ejected based on the print data. According to this configuration, a processing load resulting from the print data (for example, the load arising from the processing required for the halftone process) can be reduced by setting the print data size to the smallest possible size, rather than the size of the entire printable region. Furthermore, by employing a configuration in which the flushing data is generated separately from the print data (step S130), the printer 10 can freely set the frequency at which the flushing dots are formed, which makes it possible to carry out the flushing at a frequency necessary to prevent the nozzles 21 from clogging.

Next, examples will be given of several methods for distinguishing between image forming dots and flushing dots when viewing a printing result on the printing medium.

In the case where a plurality of copies of the same printing target image have been printed onto printing media, dots whose positions do not match from printing medium to printing medium may at least be determined to be flushing dots.

When comparing a black-and-white printing and a color printing of a printing target image that is a color image, color dots (C, M, and Y) observed in the black-and-white printing may be determined to be flushing dots, and dots in the same positions as those flushing dots in the color printing may also be determined to be flushing dots.

In the case where the same printing target image has been printed onto a plurality of printing media whose lengths in the transport direction D are different (in the case where the printing target image itself is within all of the printing media), dots whose positions do not match from printing medium to printing medium may at least be determined to be flushing dots.

3. Variations

The invention is not intended to be limited to the aforementioned embodiment, and the invention can be realized in various forms without departing from the essential spirit thereof; for example, variations such as those described hereinafter are also possible. Appropriate combinations of some or all of the embodiment and the variations also fall within the scope of the disclosure of the invention.

Variation 1

The foregoing describes a case where all of the margin values WU, WB, WL, and WR are values greater than 0. However, in the case where double-sided printing is selected as one of the printing conditions, the print control unit 12*a* may cause the print head 20 to execute the flushing having provided the margin at both ends of the printing medium in the transport direction D. In addition to the margin value WU, the print control unit 12*a* sets the margin value WB to a predetermined value greater than 0 in the case where double-sided printing has been selected in step S110. On the other hand, in the case where one-sided printing is selected in step S110, the margin value WB is set to 0 (with the margin value WU set to the predetermined value greater than 0; the settings for the margin values WL and WR are of no concern here). The flushing data or the control signal CS is generated based on these settings. In the case of double-sided printing, the leading end of the printing medium during printing on one side becomes the following end after transport by the third transport unit, or in other words, during printing on the reverse side. Likewise, the following end of the printing medium during printing on the one side becomes the leading end during printing on the reverse side. In other words, both ends of the printing medium in the transport direction D may enter into the gap C1, the gap C2, and so on, and thus those both ends are provided with margins and exempted from ink ejection. As a result, the occurrence of jams can be avoided when printing on both sides in double-sided printing.

Variation 2

Although the plurality of line heads 20*a*, 20*b*, 20*c*, and 20*d* are installed along the transport direction D at set intervals in the printer 10, it is not necessarily the case that the actual intervals will be the ideal design values, depending on the precision with which the heads are attached during manufacture.

Figure 9:
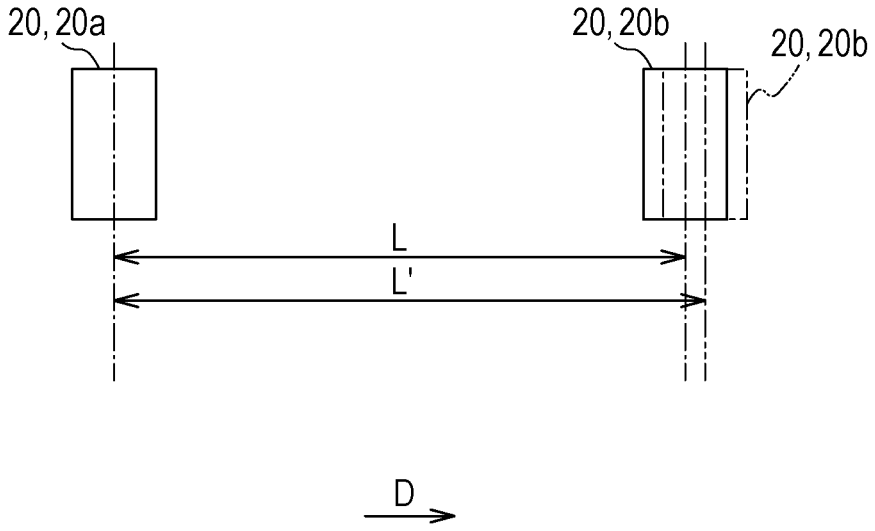
FIG. 9 is a diagram illustrating skew in an interval at which two line heads are installed.

FIG. 9 is a diagram illustrating skew in an interval at which two of the line heads (the line heads 20*a* and 20*b*, for example) are installed in the printer 10. It is assumed that the ideal distance between the two line heads in the transport direction D is, for example, L. However, due to error in the attachment, the position where the line head 20*b* is attached is skewed downstream in the transport direction D (indicated by the double-dot-dash line) from the ideal position (indicated by the solid line), and thus the distance between the two line heads is L'.

In such a state, when ink is ejected by the line head 20*b* at the correct timing (that is, a timing that assumes a distance of L between the line heads), there is a risk that dots will land on regions of the printing medium where ink is not supposed to be ejected (the margins), will land on an area where the printing medium is not present (on the endless belt 16*c*), and so on. Accordingly, the print head 20 carries out ink ejection based on print data to which has been added blank data for correcting positional skew caused by error in the installation intervals between line heads in the transport direction D. Specifically, the print control unit 12*a* adds blank data WS that is equivalent to the stated error (that is, L'−L).

Figure 10:
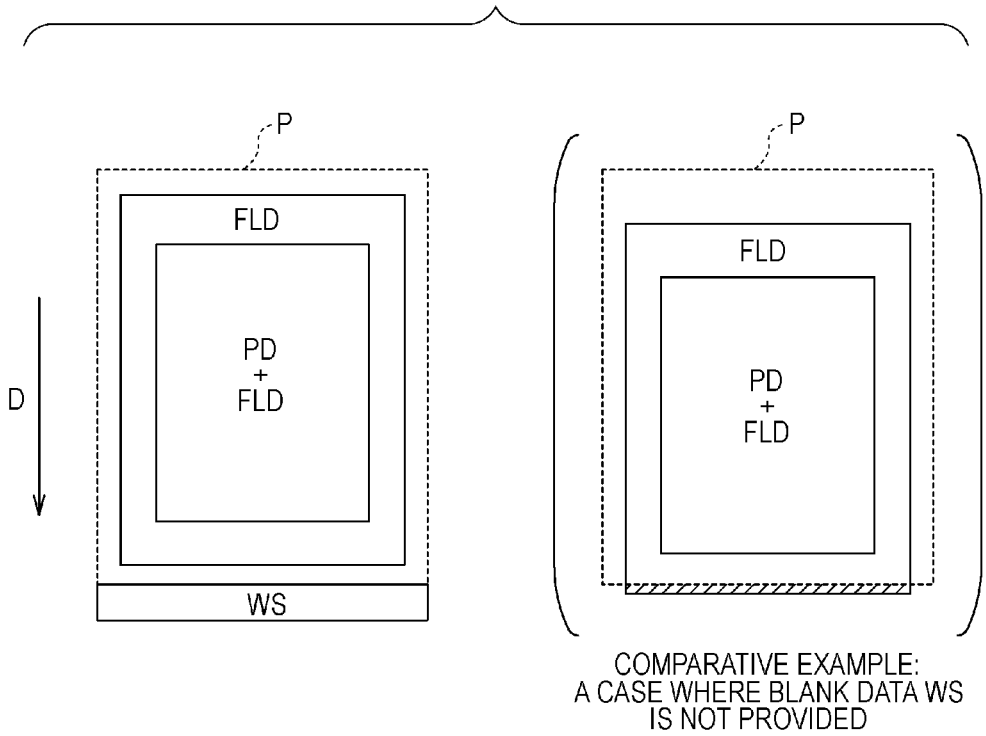
FIG. 10 is a diagram illustrating ink ejection based on print data to which blank data has been added.

FIG. 10 illustrates an example of ink being ejected onto the printing medium P based on the print data to which the blank data WS has been added. As shown in FIG. 10, the blank data WS is added during data processing, to an area downstream in the transport direction D from a leading end position of the printing medium P. In the case where the blank data WS is present, the line head 20*b* starts ejecting ink based on the blank data WS at the stated correct timing. However, at this point in time, the leading end of the printing medium P is present upstream in the transport direction D from the position where the dots from the line head 20*b* land, by an amount equivalent to the stated error (L'−L). Furthermore, because the blank data WS is data in which all pixels are set to "dot off", no ink is actually ejected during the ink ejection based on the blank data WS.

When the ink ejection based on the blank data WS has finished (that is, when transport of an amount equivalent to the aforementioned error has finished), the leading end of the printing medium P reaches the position where dots from the line head 20*b* land; however, the margin is provided at the leading end of the printing medium P as described above, and thus the line head 20*b* still does not eject ink. Once transport of an amount equivalent to the margin has ended, ink is ejected based on the flushing data FLD, the print data PD, and so on, and the flushing dots, image forming dots, and so on are formed in their correct positions on the printing medium P. As indicated by the comparative example on the right side in FIG. 10, in the case where ink is ejected by the line head 20*b* based on data to which the blank data WS has not been added, there are situations where some of the dots to be formed on the printing medium P will be formed outside the printing medium P (that is, on the endless belt 16*c*) (see a range indicated by hatched lines in the comparative example), although this does also depend on the magnitude of the aforementioned error.

According to Variation 2, the print control unit 12*a* causes the flushing to be executed so that the flushing dots are not formed in positions that overlap with the blank data WS. For example, the flushing data FLD is generated so as not to overlap with the blank data WS, or the timing at which the stated control signal CS waveform is applied to the nozzles 21 is delayed from a timing employed when the stated error is not present by an amount equivalent to the period applied to the nozzles 21 by the blank data WS. According to this configuration, a situation in which the flushing is carried out during the period in which the blank data WS is applied (that is, a period in which ink is not supposed to be ejected) and the endless belt 16*c*, the ends of the printing medium P, and so on are soiled can be avoided. Accordingly, the occurrence of jams caused by such soiling can also be avoided.

Variation 3

As illustrated in FIG. 2, the printer 10 includes detection units (the sensors 17*a* and 17*b*; a type of printing medium sensor 17) capable of detecting printing medium jams upstream from the line heads 20*a*, 20*b*, 20*c*, and 20*d* in the transport direction D. These detection units are provided in a plurality of locations, as indicated by the sensors 17*a* and 17*b*. For example, the print control unit 12*a* determines that a jam has been detected between the two sensors when a notification that the leading end of the printing medium has been detected is received from one of the sensors but a notification that the leading end of the printing medium has been detected is not received from the other sensor, which is located closer to the line heads 20*a*, 20*b*, 20*c*, and 20*d* in the transport direction D than the stated one sensor, within a predetermined amount of time. In the case where it is determined that a jam has occurred in this manner, the print control unit 12*a* prohibits flushing from being executed (and also prohibits the printing target image from being printed simultaneously) by stopping the output of the signals for driving the print head 20 or the like. According to Variation 3, the flushing can be prevented from being executed when the printing medium is not present and soiling the endless belt 16*c* in the case where a jam has occurred prior to the printing medium being transported below the print head 20.

Variation 4

The printer 10 may be capable of switching between a monochromatic mode performed using only K ink from the line head 20*d* and a color mode performed using the CMYK inks from the line heads 20*a*, 20*b*, 20*c*, and 20*d* when reproducing the printing target image on the printing medium based on the print data. Specifically, the print control unit 12*a* switches which of the line heads 20*a*, 20*b*, 20*c*, and 20*d* are to be driven based on the print data sent from the PC 40, operations made through the operation panel 15, or the like. It is preferable for the margin value WU to be a value greater than 0 in this case as well, regardless of which mode is being used. In other words, the leading end of the printing medium may enter into the gap C1, the gap C2, or the like regardless of whether the mode is the color mode or the monochromatic mode, and thus the margin is provided at the leading end of the printing medium and ink is not ejected thereon. According to Variation 4, the occurrence of jams can be avoided.

Variation 5

Rather than reproducing the printing target image on a single printing medium based on the print data, the printer 10 may reproduce the printing target image on a plurality of printing media. Even in this case, the flushing control process carried out for the first page may be carried out for the second and subsequent pages as well. Specifically, the margin value WU may be set to a value greater than 0 for the printing medium on the second and subsequent pages. The same applies to the margin values WB, WL, and WR. According to Variation 5, the occurrence of jams can be avoided for the second and subsequent pages as well.

Variation 6

As one of the printing conditions, the print control unit 12*a* may set the position of the printing target image in the printing medium P to a desired value in response to a user input regarding a distance from at least one of the four ends of the printing medium P, such as the distance from the leading end of the printing medium P. Furthermore, the distances from the ends of the printing medium P may be different from the margin values WU, WB, WL, and WR. In this case, the printing target image can be reproduced in the user's desired position, and thus the ease with which the printer 10 can be operated can be increased. Note that these distances may be the same values as the margin values.

Meanwhile, in the case where the distances from the ends inputted by the user are less than the margin values and the position of the printing target image has been specified for a region not contained in the printable region of the printing medium P, the print control unit 12*a* may communicate the situation to the user as an error. In the case where the position of the printing target image has been specified for a region not contained in the printable region, it is possible that ink will land on the ends of the printing medium P and in the vicinity thereof, leading to the occurrence of a jam; thus communicating the error makes it possible to reduce the likelihood of such a jam occurring. In this case, the printing target image can be reproduced on the printing medium P based on the specified position if the distance from the ends inputted by the user is greater than the margin value.

Variation 7

The size of the print data PD may be the same as or greater than the size of the flushing data FLD. If ink is ejected based on the print data PD, the ink can be prevented from thickening in the same manner as with the flushing process.

Meanwhile, the size of the flushing data FLD may be greater than the size of the print data PD. Particularly, in this case, ink can be ejected at a predetermined frequency regardless of whether or not ink is ejected based on the print data PD, and thus the nozzles can be prevented from clogging or clogs in the nozzles can be cleared. In addition, the processing load can be reduced if the size of the print data PD is lower.

Variation 8

The first transport unit may be a transport drum rather than the endless belt 16*c*. With respect to the size of these transport surfaces in the transport direction D, it should be noted that it is preferable for the entire printing medium P to be transported by the first transport unit from when ink starts to be ejected onto the printing medium P from the line head 20*a* to when ink is finished being ejected by the line head 20*d*. This stabilizes the transport of the printing medium P, making it easy to keep a space between the line heads 20*a*, 20*b*, 20*c*, and 20*d* and the first transport unit; this in turn makes it possible to increase the accuracy of reproduction of the printing target image. Specifically, it is preferable for a sum of the distance the printing medium P is transported from when the line heads 20*a*, 20*b*, 20*c*, and 20*d* are caused to start ejecting ink based on the print data to when that ink ejection is stopped and the length in the transport direction D of the printing medium P specified by the printing conditions to be less than the length in the transport direction D of the transport surface of the endless belt 16*c* or the transport drum.

Note that the width of the transport surface of the first transport unit in the lengthwise direction may be greater or less than the width of the printing medium P. The transport of the printing medium P can be stabilized even in the case where the width of the transport surface of the first transport unit is greater than the width of the printing medium P. Meanwhile, to transport the printing medium P from the first transport unit to the second transport unit, it is necessary to transport the printing medium P to the transport path 16*f* without the leading end thereof entering into a gap between transport units; however, proper transport, in which that leading end does not enter into the gap, can be realized through the embodiment and the variations described above.

Variation 9

The margin value WU of the leading end may be found as follows.

Figure 11A:
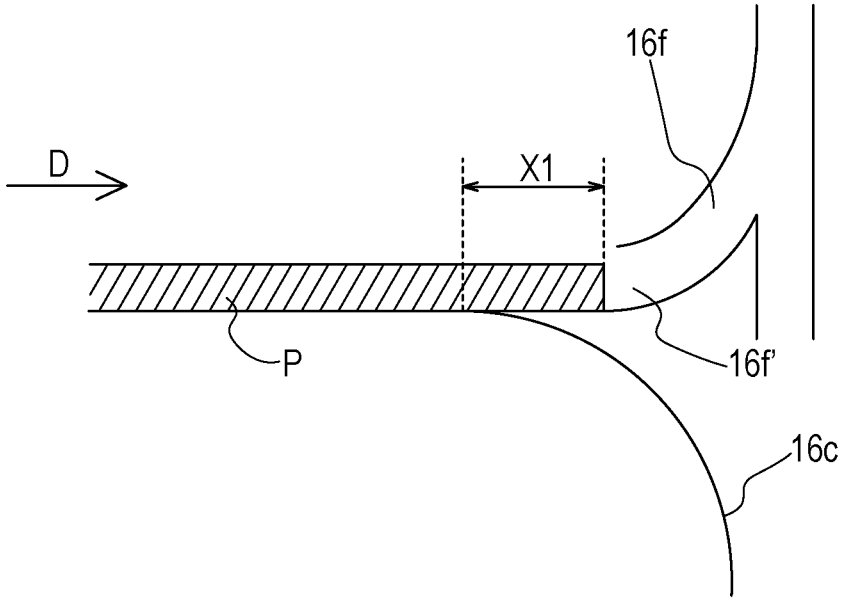
FIGS. 11A and 11B are diagrams illustrating an example of an area where a downstream side of an endless belt and an intake port in a transport path are in proximity with each other, in an enlarged manner.
Figure 11B:
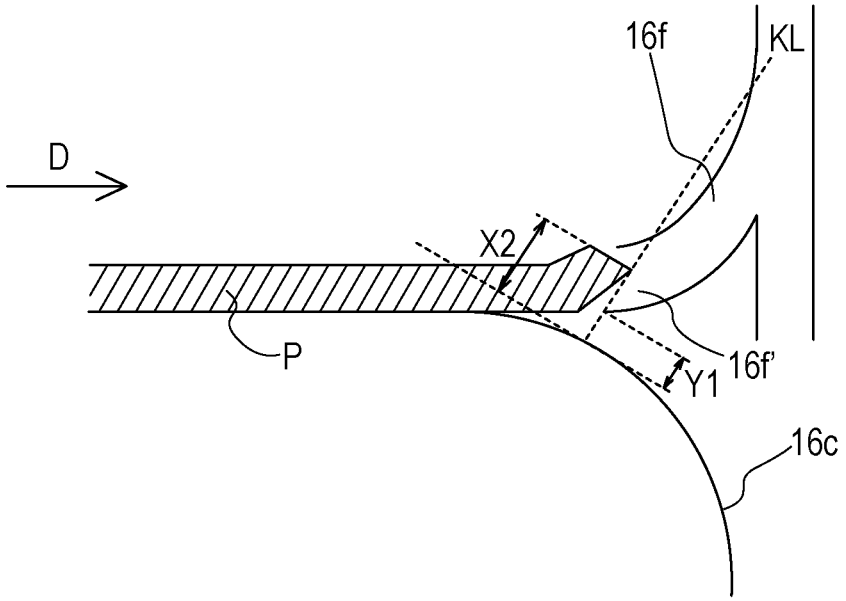

FIGS. 11A and 11B are diagrams illustrating an example of an area where the downstream side of the endless belt 16*c* and an intake port 16*f'* in the transport path 16*f* are in proximity with each other, in an enlarged manner. In FIG. 11A, the intake port 16*f'* is a section of the transport path 16*f* that is located toward the endless belt 16*c*, and the printing medium P is conducted to the transport path 16*f* in a stable manner via the intake port 16*f'*. A distance X1 is a distance from the area of the printing medium P that begins to separate from the endless belt 16*c* to the leading end of the printing medium P. Note that the distance X1 in FIG. 11A indicates the distance at the point in time when the printing medium P has entered into the intake port 16*f'*. In this respect, when specifying the distance X1, the intake port 16*f'* may be taken as the first point with which the printing medium P that has separated from the endless belt 16*c* makes contact. Here, in the case where the margin value WU is shorter than the distance X1 in the transport direction D, ink may land on the printing medium P in the region thereof from where the printing medium P separates from the endless belt 16*c* to where the printing medium P reaches the intake port 16*f'*, and the printing medium P may fail to be conducted to the intake port 16*f'* due to the weight of the ink. A jam can occur as a result. Accordingly, the margin value WU is set to be longer than the distance X1 in the transport direction D. As a result, the occurrence of jams can be avoided.

Meanwhile, in FIG. 11B, a distance Y1 is a minimum distance between the intake port 16*f'* and the endless belt 16*c*, and a dotted line KL is a straight line connecting the intake port 16*f'* and the endless belt 16*c* at the minimum distance. A distance X2 is a minimum distance between the leading end of the transported printing medium P and the endless belt 16*c* at the point in time when the leading end reaches the dotted line KL. In this respect, when specifying the dotted line KL, the intake port 16*f'* may be taken as the first point with which the printing medium P makes contact after separating from the endless belt 16*c*. Accordingly, in the case where the distance X2 is lower than the distance Y1, the printing medium P will not be conducted into the intake port 16*f'*, and will instead enter into the gap between the endless belt 16*c* and the transport path 16*f*. Accordingly, it is preferable to set the margin value WU to a value at which the leading end does not enter into the gap in this manner. Specifically, the margin value WU is set to a value that is longer in the transport direction D than the amount by which the distance X2 is longer than the distance Y1 at the point in time when the leading end of the transported printing medium P reaches the dotted line KL. Note that the "amount by which the distance X2 is longer than the distance Y1 at the point in time when the leading end of the transported printing medium P reaches the dotted line KL" refers to one type of ideal value for the margin value WU, where the relationship "distance X2>distance Y1" holds true when such an amount is secured at the leading end of the printing medium.

Meanwhile, the margin value WU may be set to a value greater than that described in accordance with FIGS. 11A and 11B, in consideration of variations in the transport velocity, or the like.

Variation 10

Although the foregoing describes a case where the flowchart shown in FIG. 4 is executed by the printer 10, this flowchart may be executed by the PC 40. In other words, the printer driver 41 may execute the processes of steps S100 to S140 in accordance with a program, and may instruct the printer 10 to eject ink based on the combined data (or eject ink based on the print data and carry out flushing based on the driving signal DS and the control signal CS).

Furthermore, in addition to ink, "liquid" in this specification refers to any liquid or fluid whose viscosity can change due to the evaporation of water content, a solvent, or the like.

What is claimed is:

1. A printing apparatus, having a plurality of nozzles for ejecting a liquid, that is capable of executing an operation for ejecting the liquid from the nozzles based on print data for printing an image specified as a printing target, the apparatus comprising:

a first transport unit that transports a printing medium in a transport direction;

a line head, having a nozzle row in which the plurality of nozzles are arranged in a direction that intersects with the transport direction, that ejects the liquid from the nozzles onto the printing medium transported by the first transport unit;

a second transport unit, disposed at a distance from the first transport unit downstream from the first transport unit in the transport direction, that further transports the printing medium transported by the first transport unit; and a control unit that causes the line head to execute a flushing operation for ejecting the liquid from the nozzles at a predetermined frequency, wherein when causing the line head to execute the flushing operation, the control unit provides a margin, where the liquid does not land, in a region corresponding to a predetermined distance from a leading end of the printing medium that is an end of the printing medium located toward the second transport unit.

2. The printing apparatus according to claim 1, wherein a size, in the transport direction, of the margin at the leading end is longer than a gap between the first transport unit and the second transport unit.

3. The printing apparatus according to claim 1, further comprising:

a separating plate, located between the first transport unit and the second transport unit, for separating the printing medium from the first transport unit, wherein a size, in the transport direction, of the margin at the leading end is longer than a gap between the first transport unit and the separating plate.

4. The printing apparatus according to claim 1, wherein the size of the margin at the leading end is longer, in the transport direction, than a minimum distance between the leading end and a part of the printing medium where the printing medium begins to separate from the first transport unit at a point in time when the leading end is transported into an intake port of the second transport unit.

5. The printing apparatus according to claim 1, wherein when causing the line head to execute the flushing operation, the control unit provides a margin, where the liquid does not land, at both ends of the printing medium in the direction that intersects with the transport direction.

6. The printing apparatus according to claim 1, further comprising:

a third transport unit that inverts the front and back of the printing medium transported by the first transport unit and sends the inverted printing medium to the first transport unit from upstream in the transport direction, wherein when causing the line head to eject the liquid onto both sides of the printing medium and execute the flushing operation, the control unit provides a margin, where the liquid does not land, at both ends of the printing medium in the transport direction.

7. The printing apparatus according to claim 1, wherein a plurality of the line heads are disposed along the transport direction; and when causing the line heads to eject the liquid based on print data to which has been added blank data for correcting positional skew caused by error in intervals between the plurality of line heads in the transport direction, the control unit causes the flushing operation to be executed while avoiding a location of the blank data.

8. The printing apparatus according to claim 1, further comprising:

a detection unit that detects a printing medium jam upstream from the line head in the transport direction, wherein the control unit prohibits the flushing operation from being executed in the case where the printing medium jam has been detected by the detection unit.

9. The printing apparatus according to claim 1, wherein the control unit can specify a different value for a distance, in the transport direction, between a region where the liquid is ejected based on the print data and the leading end, from the size, in the transport direction, of the margin at the leading end.

10. The printing apparatus according to claim 1, wherein in the case where a distance, in the transport direction, between a region where the liquid is ejected based on the print data and the leading end that is smaller than a value for the size, in the transport direction, of the margin at the leading end is specified, the control unit causes an error to be communicated.

11. The printing apparatus according to claim 1, wherein in the case where a distance, in the transport direction, between a region where the liquid is ejected based on the print data and the leading end that is greater than a value for the size, in the transport direction, of the margin at the leading end is specified, the control unit causes the line head to eject the liquid based on the specified value.

12. The printing apparatus according to claim 1, wherein, of a region of the printing medium where the liquid can be ejected, the print data is data of a size corresponding to a region of the printing medium onto which the liquid is ejected based on the print data; and the control unit causes the line head to execute the flushing operation on a region of the printing medium that is greater than the region corresponding to the print data.

13. The printing apparatus according to claim 1, wherein the control unit can switch the operation for ejecting the liquid from the nozzles based on the print data between execution in a monochromatic mode and execution in a color mode; and the margin at the leading end of the printing medium is provided regardless of whether the ejection is executed in the monochromatic mode or in the color mode.

14. The printing apparatus according to claim 1, wherein the control unit can execute the operation for ejecting the liquid from the nozzles based on the print data on a plurality of pieces of the printing medium; and when causing the line head to execute the flushing operation, the control unit provides a margin, where the liquid does not land, at the leading end of each of the plurality of pieces of the printing medium.

15. A printing method using a printing apparatus, having a plurality of nozzles for ejecting a liquid, that is capable of executing an operation for ejecting the liquid from the nozzles based on print data for printing an image specified as a printing target, wherein the printing apparatus includes:

a first transport unit that transports a printing medium in a transport direction;

a line head, having a nozzle row in which the plurality of nozzles are arranged in a direction that intersects with the transport direction, that ejects the liquid from the nozzles onto the printing medium transported by the first transport unit; and a second transport unit, disposed at a distance from the first transport unit downstream from the first transport unit in the transport direction, that further transports the printing medium transported by the first transport unit, the method comprising:

providing a margin, where the liquid does not land, in a region corresponding to a predetermined distance in the transport direction from a leading end of the printing medium that is an end of the printing medium located toward the second transport unit, when causing the line head to execute a flushing operation for ejecting the liquid from the nozzles at a predetermined frequency based on data aside from the print data.

* * * * *